US006799964B2

(12) United States Patent
Bidart

(10) Patent No.: US 6,799,964 B2
(45) Date of Patent: Oct. 5, 2004

(54) INJECTOR FOR USE IN A DEVICE FOR COMBUSTION OF CORROSIVE PRODUCTS

(75) Inventor: Rene Bidart, Manosque (FR)

(73) Assignee: Atofina, Puteaux (FR)

( * ) Notice: Subject to any disclaimer, the term of this patent is extended or adjusted under 35 U.S.C. 154(b) by 0 days.

(21) Appl. No.: 10/149,124

(22) PCT Filed: Dec. 5, 2000

(86) PCT No.: PCT/FR00/03391

§ 371 (c)(1),
(2), (4) Date: Oct. 17, 2002

(87) PCT Pub. No.: WO01/42711

PCT Pub. Date: Jun. 14, 2001

(65) Prior Publication Data

US 2003/0108838 A1 Jun. 12, 2003

(30) Foreign Application Priority Data

Dec. 7, 1999 (FR) ..... 99 15401

(51) Int. Cl.[7] ..... F23G 7/08
(52) U.S. Cl. ..... 431/5; 431/181
(58) Field of Search ..... 431/5, 181, 351, 431/353, 192; 239/424.5

(56) References Cited

U.S. PATENT DOCUMENTS 1,616,862 A * 2/1927 Lewis ..... 431/181
3,856,457 A 12/1974 Miller
4,483,832 A * 11/1984 Schirmer ..... 423/210
4,505,667 A * 3/1985 Frusta et al. ..... 431/182
4,544,350 A * 10/1985 Ware et al. ..... 431/285
4,988,287 A * 1/1991 Stegelman et al. ..... 431/284
5,516,281 A 5/1996 Molodow
5,545,033 A 8/1996 Dick et al.
6,142,765 A * 11/2000 Ramaseder et al. ..... 431/9
6,579,088 B2 * 6/2003 Legiret et al. ..... 431/181

FOREIGN PATENT DOCUMENTS

| | | |
|---|---|---|
| DE | 19504667 | 8/1996 |
| EP | 0069245 | 1/1983 |
| FR | 1603910 | 6/1971 |

* cited by examiner

*Primary Examiner*—Alfred Basichas
(74) *Attorney, Agent, or Firm*—Millen, White, Zelano & Branigan, P.C.

(57) ABSTRACT

The invention concerns an injector for the use in particular for combustion of corrosive products or a mixture thereof. Said injector comprises a flush cut tube housing, closed at one end, wherein are juxtaposed at least two flush cut tubes, and not more than eight tubes, said tubes perpendicularly passing through the wall, and at least one lateral branch pipe. The invention also concerns the use of said injector for implementing a method for the combustion of chlorine-containing corrosive products or a mixture thereof.

12 Claims, 5 Drawing Sheets

INJECTOR FOR USE IN A DEVICE FOR COMBUSTION OF CORROSIVE PRODUCTS

BACKGROUND OF THE INVENTION (1) Field of the Invention

The subject of the present invention is an injector that can be used in particular in a device for the combustion of corrosive residues such as those containing halogenated, particularly chlorinated, hydrocarbons.

(2) Description of Related Art

The industrial manufacture of chlorinated organic compounds generates abundant quantities of residue, often containing chlorine. These residues may either be in the gaseous state, as for example in the case of the manufacture of vinyl chloride or of its polymers or copolymers, or in the state of liquid and/or tarry solid, obtained in the manufacture of aliphatic, cycloaliphatic and/or aromatic chlorinated hydrocarbons. The composition of these chlorinated residues varies according to their origin. Certain residues comprise chlorinated tarry products, at least some of the constituents of which contain more than 7 carbon atoms per molecule. Other chlorinated residues comprise chlorinated $C_4$ compounds and/or chlorinated $C_6$ compounds. These chlorinated residues may be accompanied by other compounds comprising chlorinated $C_1$ to $C_4$ constituents. These chlorinated residues may also comprise polychlorinated biphenyls (PCBs) used as dielectric fluids and coolants and which need to be got rid of, given the ban on the use of such products.

One means of solving the problem of the build-up of these residues and of the contamination of the air and/or of the water courses into which they may be discharged, is to burn them at high temperature in a combustion chamber, with the recovery of gaseous hydrochloric acid which can be put into the form of an aqueous solution, and possibly the production of steam.

More specifically, these chlorinated gaseous and/or liquid residues are burned in the presence of excess air and water at temperatures ranging from 900° C. to 1450° C., and generally between 1200° C. and 1300° C. in an installation comprising, in particular, a burner into which the chlorinated residues and an oxidizer are injected; said burner being surmounted by a furnace in which the mean residence time of the molecules is at least 3 seconds.

The hot gases leaving the furnace are quenched (rapidly cooled). The HCl formed is absorbed in absorbers, which leads to concentrated (33%) commercial solutions. Any chlorine that might be formed is absorbed in an alkaline aqueous solution.

The burning of these residues is accompanied by lively combustion which can be obtained stably and continuously only in specially designed apparatus. The problem is that the combustion of this type of residue is accompanied by difficulties and problems of various natures: the clogging of the burners and of the injectors particularly when the residues are viscous, difficulties in finding the right settings for obtaining total combustion yielding hydrochloric acid containing only a minimum of free chlorine, together with zero production of carbon, corrosion, swift degradation of the parts of a burner if certain members or walls of the apparatus are not protected with a refractory and/or antiacid coating, or with special arrangements, for example for the injection of a significant volume of cold non-combustible gas around the flame.

Patent application FR 2509016, incorporated by reference into this application, describes a device that can be used in particular for the combustion of halogenated corrosive products or product mixtures or ones likely to generate corrosive products, by bringing said products in the dispersed state into contact with an oxidizing fluid at a high enough temperature to allow the cloud of particles formed to become incandescent.

This device, depicted in FIG. 1, comprises a combustion chamber (7), a head (1) for dispersing the phase that is to be burned into said chamber, a connecting plate (2) connecting said dispersion head to the combustion chamber, fluid inlets (3), (4) and (5), and a deflector (6). Also shown in this FIG. 1 is the pipe (30) for the outlet of the combustion gases, and a blow-out seal (29).

The dispersion head (1) is an essential part of this device. This dispersion head (FIG. 3) comprises:

- a device for the axial arrival of the phase that is to be burned and of the auxiliary fluids, or injector (8), fitted with a guide (9),.
- a chamber known as a swirl chamber for introducing swirl into a primary fraction of the oxidizing phase (or of the oxidizer), allowing said primary fraction to be introduced into the combustion chamber in the form of a vortex sink flow, to which enough momentum is imparted to, by transferring the momentum, disperse the phase that is to be burned, said swirl chamber comprising a tangential inlet (15) leading said primary fraction of the oxidizing phase into an annular space contained between an external wrapper (16) and an internal wrapper (17) perforated at its upstream part and behaving like a multitude of tangential inlets, said swirl chamber ending in a conical part (18), the end of this conical part (18) and the injector (8) are dimensioned and arranged in such a way as to form a narrow annular passage (references 26 and 27);
- an inlet into the combustion chamber of a secondary fraction of the oxidizing phase (21);
- a deflector (24) toward the base of the combustion zone, allowing said secondary fraction to be deflected down toward the base of the combustion zone, said deflector delimiting a passage (28) around the combustion zone, the inlet (21) and the deflector (24) being dimensioned and arranged in such a way as to allow the secondary oxidizing fractions to constitute the complement of the oxidizing phase needed for combustion and at the same time to stabilize the incandescent cloud and to cool the deflector and the connecting plate (19), which bears the deflector (24), the shell rings (20), the inlet orifices (21) and the fixing means (22), which can be adjusted during operation with respect to the sole (25) of the combustion chamber;
- an annular leakage space (23) formed between the sole (25) and the plate (19), which allows a second part of the secondary fraction of the oxidizing phase to be introduced.

The dimensioning recommended in this document, of the various parts concerned is such that the ratio of the outside diameter (27) to the inside diameter (26) of the narrow annular passage is between 1.1 and 1.6 and preferably between 1.15 and 1.4 and that the ratio of the diameter (28) of the passage left by the deflector to the diameter (27) mentioned hereinabove is between 1.5 and 5 and preferably between 2 and 4.5.

FIG. 2 depicts details of the device for the axial arrival of the phase that is to be burned and of the auxiliary fluids, or injector.

This injector comprises:

a guide (9), a tube (12) for bringing in the fluid containing the products that are to be burned, auxiliary coaxial inlets, namely concentric tubes (10), (11) and (12) which, via the annular spaces (13) and (14) allow the top-up fuels and/or oxidizers to be introduced. Altering the geometry of the tube (10) makes it possible also to alter the configuration of the combustion cloud and to fulfill an adjustment function.

Such a device is well suited to the burning of chlorinated residues. The applicant company has used a similar device for burning liquid chlorinated residues.

Thus, for example, the applicant company has used this device for the combustion of residues containing approximately 77% by weight of chlorine. These residues in particular comprise hexachorobutadiene, hexachlorobenzene, tetrachlorobenzene, pentachlorobenzene and hexachloroethane.

This residue is a viscous liquid, the crystallization point of which is higher than 160° C.

The complete installation comprises a burner/combustion chamber assembly as depicted in FIGS. 1, 2 and 4. In FIG. 4, which depicts the dispersion head, the shell rings (20) have been omitted and said swirl chamber ends in a frustoconical part (18), the end of this part and the injector (8), the guide (9) of which is shorter, are arranged in such a way as to form a narrow annular passage (references 26 and 27). In this device, the ratio (27)/(26) is 1.28 and the ratio (28)/(27) is 4. The installation also comprises:

a quenching device (not depicted in the figures), a string of 4 Venturi-type absorbers (not depicted in the figures), and a neutralizing column (not depicted in the figures).

The depression is created in the combustion chamber by virtue of 4 Venturis in series and an extractor.

The residue, the flow rate of which is 2500 kg/h, is conveyed to the burner by the concentric tube (12). The temperature in the combustion chamber is 1200° C. The depression in this chamber is kept at approximately 100 mbar.

2700 $Sm^3/h$ of atomization air at $0.5\times10^5$ Pa is introduced through the annular space (27)/(26), that is to say via the tangential inlet (15).

10 $Sm^3/h$ of tertiary air is injected via the annular space (14) between the tubes (10) and (11).

An overall secondary-air flow rate of 2500 $Sm^3/h$ is made up of a first flow of secondary air drawn in through the holes (21) in the bottom plate (19) and of a second flow of secondary air drawn in through the annular leakage space (23).

The composition of the flue gases leaving the combustion chamber is as follows (percentages by weight):

| | |
|---|---|
| $O_2$ | 3.7% |
| $N_2$ | 57.0% |
| $CO_2$ | 20.3% |
| $Cl_2$ | 0.4% |
| HCl | 14.5% |
| $H_2O$ | 4.1% |

After these flue gases have been treated in the absorbers, a clear hydrochloric solution is obtained containing 30 wt % HCl.

The Applicant company has found that, although it yielded excellent combustion of said chlorinated residues, this device did, over time, exhibit disadvantages due in particular to the device for the axial arrival of the chlorinated residues to be burned and of the auxiliary fluids or injector depicted in FIG. 2.

What the Applicant company actually found was that the passages in the rings formed by the concentric tubes often became blocked. These blockages led to said injector being changed on average every 30 days.

Because of the expensive material (tantalum) of which these concentric tubes are made, these operations had a serious impact on the budget. These changes took several hours, and also led to costly cooling of the furnace, giving rise to a drop in productivity.

In addition, as the tubes were becoming blocked, the combustion of the chlorinated derivatives was disturbed by a haphazard supply of fluids (fuel and oxidizer), leading to a disruption in the quality of the outfall.

In order to reduce the cost of the operations, the Applicant company modified the nature of the material of which the tubes were made and used ordinary steel.

In addition to the blockages mentioned above, the Applicant company found that the tubes became holed, leading to migration of fluids from one tube to the other.

Another disadvantage observed by the Applicant company was erosion of the "tip" or end of the injector, leading to poor atomization of the products to be burned and therefore to poor combustion.

BRIEF SUMMARY OF THE INVENTION

DETAILED DESCRIPTION OF THE INVENTION

The Applicant company has now found that it is possible to reduce, or even to eliminate, the abovementioned drawbacks by modifying the design of said injector.

Figure 5:
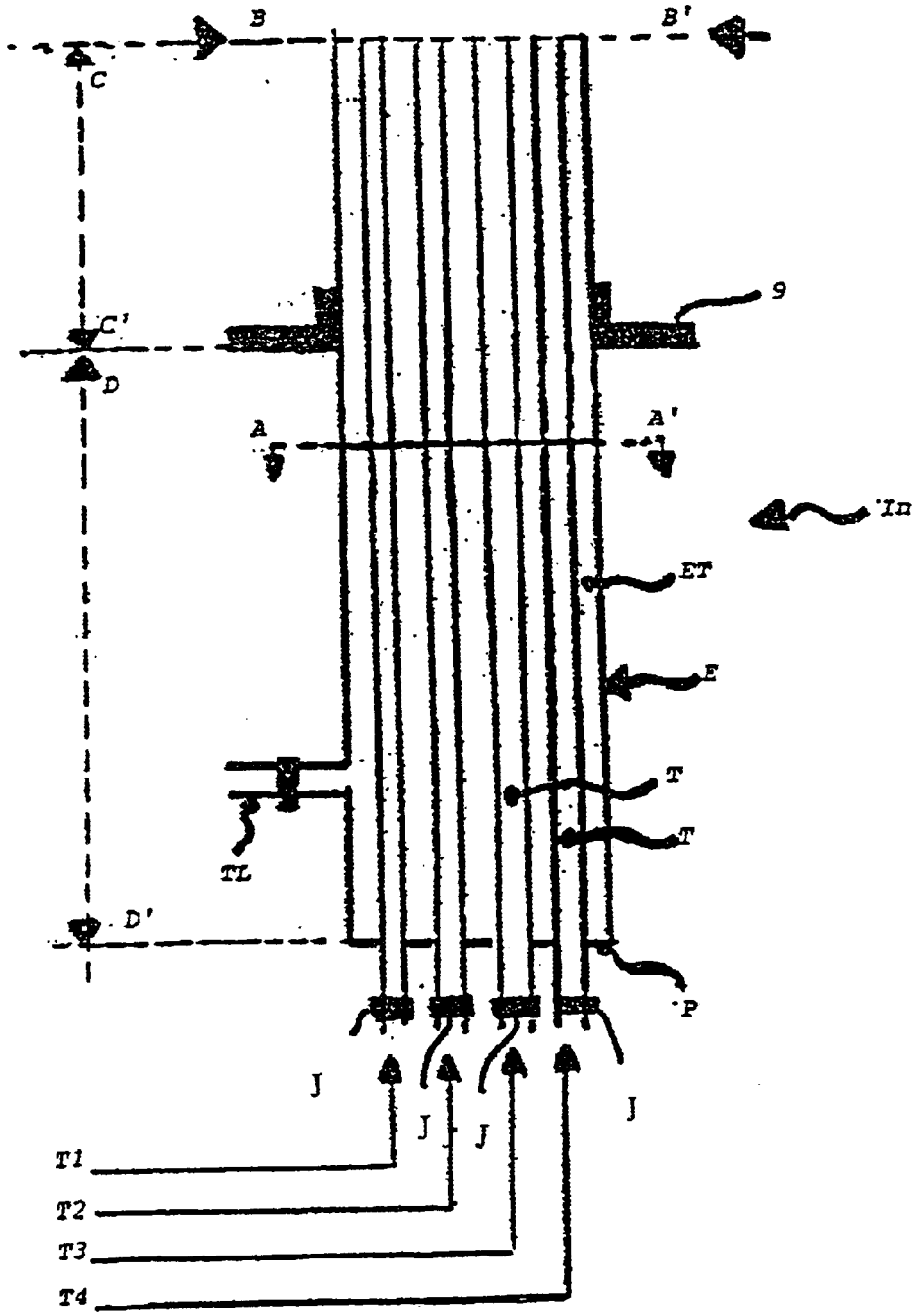
FIG. 5 depicts an injector according to the present invention.

The subject of the present invention is therefore an injector In as depicted schematically in FIG. 5, that can be used in particular in a device for the combustion of corrosive products or product mixtures or those likely to generate corrosive products by bringing said products (in the dispersed state) into contact with an oxidizer at a temperature that allows said products to burn, characterized in that it comprises a straight cylindrical wrapper tube (E), closed at one end by a wall (P), inside which tube are juxtaposed at least 2 straight tubes (T) and at most 8 tubes, preferably 4 or 5 tubes, said tubes passing at right angles through the wall (P), and at least one lateral nozzle (TL) situated near the wall (P).

Figure 6:
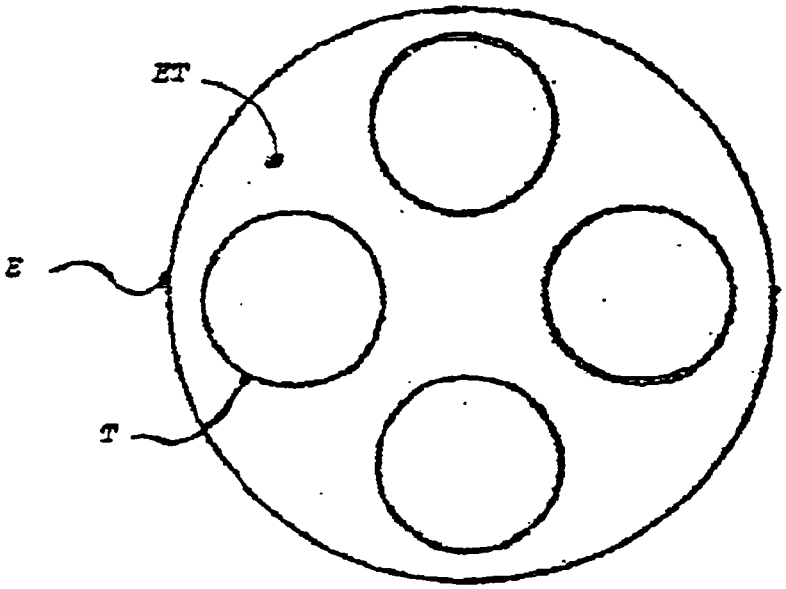
FIG. 6 depicts a plan view according to the present invention.
Figure 7:
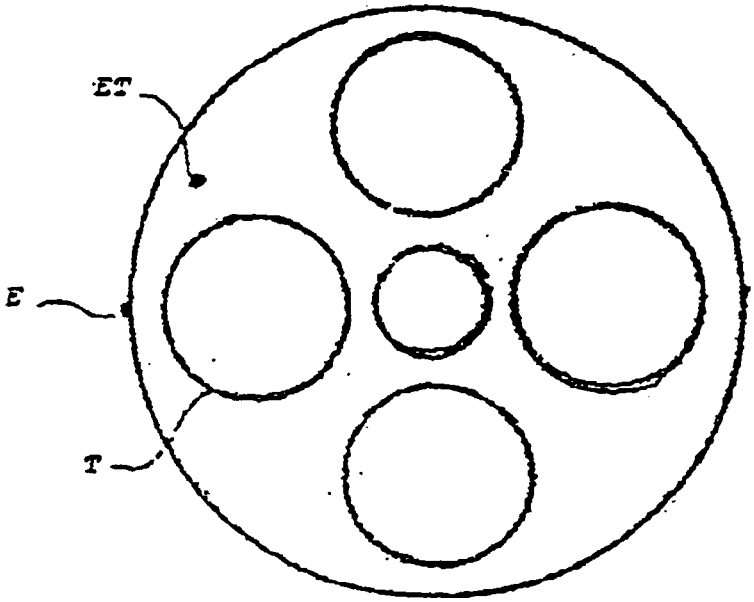
FIG. 7 depicts a plan view according to the present invention.

According to the present invention, these tubes (T) may have identical or different inside diameters. These tubes (T) may be arranged randomly but it is preferable for them to be arranged in a ring. FIG. 6 depicts a section through the injector on AA' of FIG. 5, said injector containing 4 tubes of the same diameter arranged in a ring. FIG. 6 depicts a section through an injector comprising 5 tubes: 4 tubes of the same diameter are arranged in a ring, and the 5th, of smaller diameter, is central.

According to the present invention, at least one of the tubes (T) conveys corrosive products or product mixtures for burning and at least one of the tubes (T) conveys all or some of the oxidizer needed for the combustion. This oxidizer may be air, oxygen-enriched air or, alternatively, oxygen.

Depending on the calorific value of the products that are to be burned, a top-up fuel such as propane, vent gases from the manufacture of PVC, fuel, etc. may be supplied. This top-up fuel, according to the present invention, may be conveyed by one of the tubes (T) of the device.

The space created by the juxtaposed tubes (T) inside the wrapper tube (E)—which space is denoted by (ET)—may be swept by a fluid for cooling the tubes (T) or alternatively may bring in top-up oxidizer for combustion.

This fluid is preferably air, humidified air, water, steam and is introduced, preferably tangentially, to the wrapper tube (E) and preferably at its lower part via a nozzle (TL).

The thicknesses of the tubes (T) and of the tube (E) may vary to a large extent. They are dependent on the material used and on the corrosiveness of the products that are to be destroyed. Advantageously, these thicknesses will be at least equal to 1.5 mm and preferably between 1.5 and 3 mm.

According to one embodiment of the injector In according to the invention, it is recommended that the various tubes (T) be dimensioned in such a way that the ratio of the outside diameter De of a tube (T) to the inside diameter Di of the same tube (T) is between 1.2 and 1.6 and preferably between 1.25 and 1.5.

Furthermore, according to the present invention, the ratio of the total internal surface area of the tubes (T), $\Sigma S_T$, to the internal passage cross-sectional area of the tube (E), $S_{ET}$, containing n tubes (T) is between 1 and 1.50 and preferably between 1.05 and 1.25.

The length of the tube (E) is 20 to 30 times the inside diameter of said tube (E), and preferably 22 to 26 times this diameter.

It is the task of the person skilled in the art to select the precise ratios, within the limits recommended above, according in particular to the flow rates chosen for the corrosive products that are to be destroyed and the various other fluids.

The tubes are supplied upstream of the wall (P) by hoses which are fitted with "quick-fit" connectors (J) of the Surlock® type, allowing them to be fitted and removed quickly.

Upstream of the wall (P), the tubes (T) may adopt a curvature so as to make them easier to connect to the supply hoses. Their lengths, still upstream of the wall (P) may be identical or different and depend on the size of the device.

The ends of the tubes (T) are at the same level (in the same plane) as the end of the tube (E) (line BB' in FIG. 5).

According to the present invention, the injector In of the present invention can be arranged vertically or horizontally.

Another subject of the present invention also relates to the use of said injector described hereinabove for implementing a method for the combustion of corrosive products or corrosive product mixtures likely to generate corrosive products.

According to this method, the phase(s) containing the products to be burned is (are) introduced in liquid and/or gaseous form along the axis of the vortex sink formed by the primary fraction of the oxidizing phase practically as far as the depression region of said vortex sink, the momentum conferred upon the vortex sink being enough to cause the phase to be burned to be dispersed into particles through the transfer of momentum and the secondary fraction of the oxidizing phase is introduced separately at a flow rate and in one or more directions making it possible, simultaneously, to provide the complement of oxidizing phase needed for combustion, to cool the part of the device surrounding the combustion zone and, in particular, the deflector allowing the secondary fraction to be deflected toward the base of the combustion zone and to stabilize the incandescent cloud.

The products to be burned are introduced preferably in liquid form at a flow rate ranging from 500 to 3500 kg/h and preferably between 1200 and 3000 kg/h. When introduced in gaseous form, their flow rate is between 5 and 15 $Sm^3/h$.

The flow rate of the primary fraction of the oxidizing phase (also known as the atomization air) is between 500 and 5000 $Sm^3/h$ and preferably between 2000 and 3500 $Sm^3/h$.

In the implementation of the method according to the invention, the combustion zone is at a depression of the order of 10 to 1500 Pa below atmospheric pressure. The pressure of the primary fraction of the oxidizing phase is 0.1 to $8.5\times10^5$ Pa higher and preferably 0.2 to $0.6\times10^5$ Pa higher than the pressure in the combustion zone.

The secondary fraction of the oxidizing phase may be introduced into the combustion chamber by induction at various points given the depression in the combustion chamber.

This secondary fraction may be introduced in a single flow, particularly deflected toward the combustion zone by means of a deflector as mentioned hereinabove, or in the form of two flows flowing one on each side of said reflector.

The total flow rate of the secondary fraction of the oxidizing phase can vary to a large extent. In general, this flow rate is calculated in such a way that the ratio of the total flow rate of the secondary fraction to the flow rate of the primary fraction is between 0.1 and 10 and preferably between 0.9 and 5.

Given the nature of the products to be burned, it is possible to supply a top-up fuel in liquid or gaseous form, and it is advantageous that this fuel be introduced through one of the tubes of the injector according to the invention.

According to the present invention, water may also be introduced into the combustion zone. This introduction is also advantageously achieved through one of the tubes of the injector according to the invention.

A top-up of oxidizing phase known as tertiary phase may be used.

If it is, this top-up is made coaxially using a nozzle arranged at right angles to the wrapper tube of the injector. This top-up is introduced at a pressure ranging from 2 bar to 10 bar and preferably at a pressure ranging from 4 to 6 bar.

The use of the injector of the present invention, aside from yielding remarkable combustion of the corrosive products, equivalent to that achieved by burners of the prior art, has the advantage that said corrosive products can be combusted over several months without there being any blockage and/or holing of one (or more) tube(s) of which said device is made. In the event that a blockage occurs in one or more tubes, there are several simple and quick options:

the use of a simple flexible wand introduced into the tube may allow the blockage to be removed without shutting the burner down (the furnace is at a depression), or alternatively, if the blockage is more sizeable, the entire device can be changed quickly, in under one hour, without an appreciable reduction in furnace temperature.

The injector of the present invention makes it possible to combust corrosive products or product mixtures under remarkable conditions.

This injector applies quite particularly to the combustion of chlorinated liquid residues which are generally viscous, possibly laden with solid particles in suspension.

These chlorinated residues as defined earlier often contain more than 40%, or even more than 75% by weight of chlorine. However, it is clearly understood that the device of the present invention can be used for the combustion of corrosive products, or those likely to yield corrosive products, containing quantities of chlorine well below 40%.

The injector according to the invention also makes it possible to burn, at the same time as the liquid chlorinated residues, gaseous chlorinated residues such as, in particular, the vent gases originating from the manufacture of polyvinyl chloride.

Another advantage is the possibility of quickly changing over the supply to a tube, given the connections (J).

The tubes (T) can also be cooled by causing air, water or humidified air to pass through the space (ET).

Given the fact that the injector of the present invention can operate for several months without blockage, better stability in the operation of the furnace, in the combustion, and improved safety are observed. The vent gases are also found to have a constant quality.

The example which follows illustrates the invention.

Injector according to the invention as depicted in FIGS. 5 and 6.

Number of tubes (T): 4: (T1), (T2), (T3), (T4).

The inside (Di) and outside (De) diameters of the 4 tubes are identical.

inside diameter: 15 mm outside diameter: 21 mm

De/Di=1.4 internal surface area of a tube: 177 $mm^2$ external surface area of a tube: 346 $mm^2$ total external surface area of the 4 tubes: 346.36×4=1385 $mm^2$ length of tubes (T): 1.45 m (including the part upstream of the wall (P))

Wrapper tube (E):

inside diameter: 51 mm, namely an internal surface area of 2043 $mm^2$ cross-sectional area of the passage $S_{ET}$ between the wrapper tube (E) and the tubes (T): 2043−1385=658 $mm^2$ ratio: $\Sigma S_T/S_{ET}$=177×4/658=1.07 length of the tube (E)=1.20 m

The tubes T1, T2, T3 and T4 are arranged as indicated in FIG. 5.

This injector is designed for an installation for the combustion of residues as described previously in the description, that is to say that the injector In of the present invention is arranged in place of the injector (8).in the dispersion head depicted in figure (4), and penetrates said dispersion head over a length of 48 cm (CC') measured from the guide (9), namely 72 cm outside of said head (DD')

The chlorinated residues to be destroyed consist on the one hand of PCBs and, on the other hand, of chlorinated residues containing approximately 80% by weight of chlorine and consist essentially of hexachlorobutadiene, hexachlorobenzene, tetrachlorobenzene and aliphatic chlorinated products such as hexachloroethane.

The PCBs are introduced via the tube (T1) at a flow rate of 400 kg/h.

The chlorinated residues are introduced by the tube (T2) at a flow rate of 1600 kg/h.

The gaseous chlorinated vent gases originating from the preparation of PVC are introduced via the tube (T3) at a flow rate of 10 $m^3$/h. Water is introduced through the tube (T4) at a flow rate of 500 kg/h.

Tertiary air is introduced into the wrapper (E) by means of the nozzle (TL) at a flow rate of 10 $m^3$/h.

2700 $Sm^3$/h of primary (or atomization) air is introduced at a pressure of about $0.5\times10^5$ Pa into the annular space (27/26) via the tangential inlet (15).

An overall flow rate of secondary air of about 2500 $Sm^3$/h is made up of a first flow of secondary air drawn in through the holes (21) in the bottom plate (19) and a second flow of secondary air drawn in through the annular leakage space (23).

The ratio (27)/(26)is 1.28 and the ratio (28)/(27)is 4.

Furthermore, the head of the injector In is 6.8 cm from the plane formed by the ends of the deflector (24).

Figure 1:
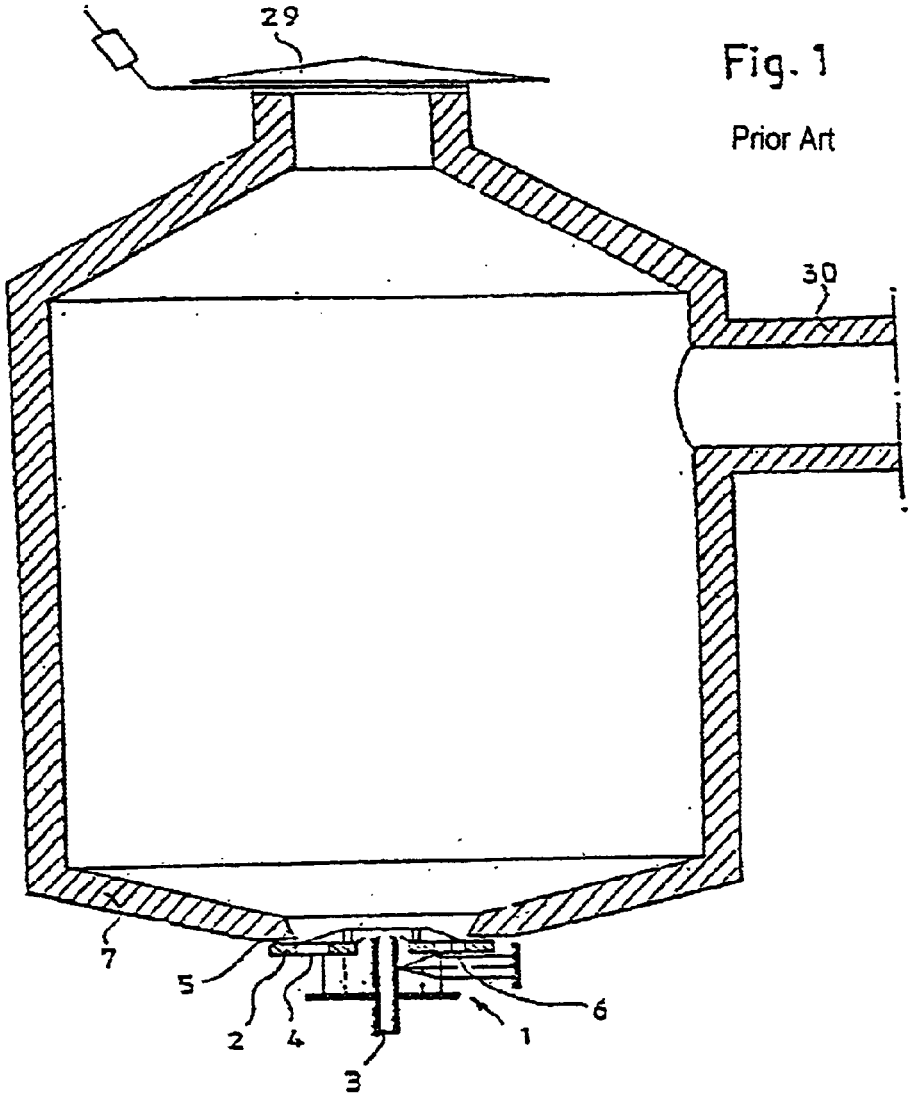
Fig. 1 Prior Art
FIG. 1 depicts a prior art device for combustion of corrosive products.
Figure 2:
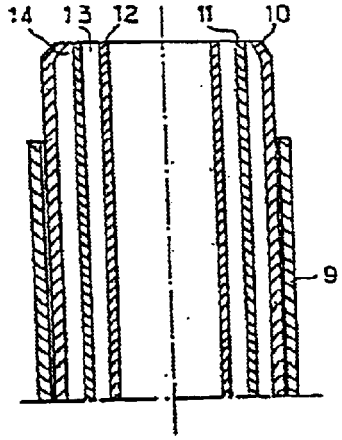
Fig. 2 Prior Art
FIG. 2 depicts a prior art injector.
Figure 3:
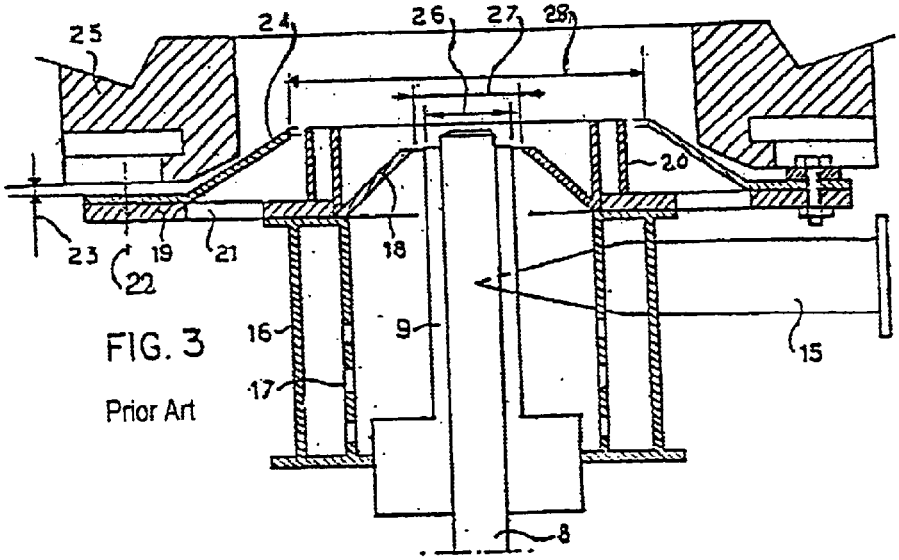
FIG. 3 Prior Art
FIG. 3 depicts a prior art disperser head.
Figure 4:
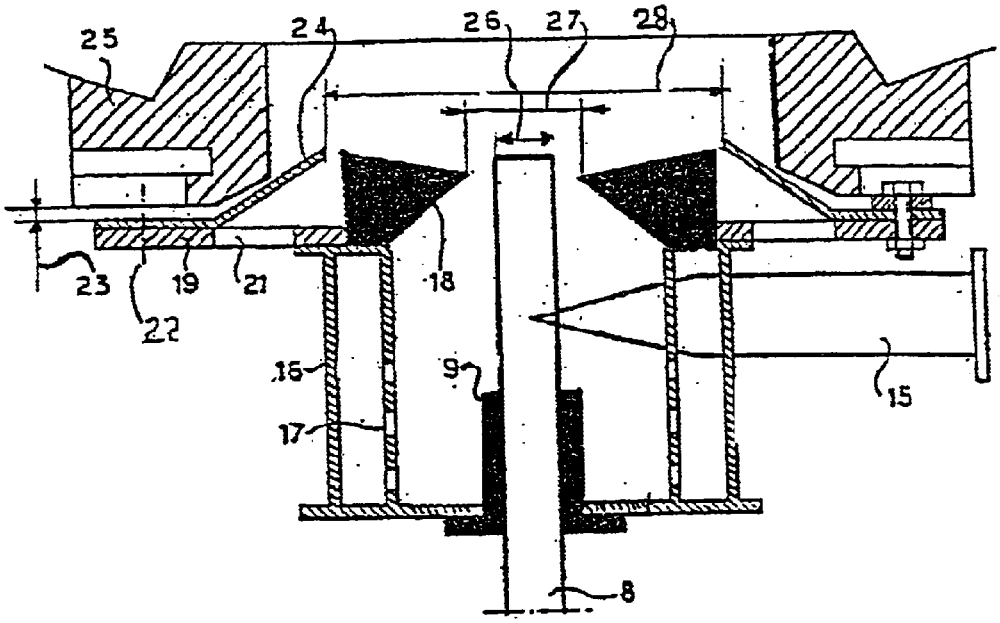
FIG. 4 Prior Art
FIG. 4 depicts a prior art disperser head.

The device for the combustion of these residues ran for 6 months without any blockages being observed in the injector of the invention. By contrast, when operating with an injector of the prior art as depicted schematically in FIG. 2, blockages are observed after 30 days of operation.

The mean composition of the flue gases leaving the combustion chamber is as follows (percentages by weight):

| | |
|---|---|
| $O_2$ | 6.0% |
| $N_2$ | 58.0% |
| $CO_2$ | 15.7% |
| $Cl_2$ | 0.4% |
| HCl | 15.8% |
| $H_2O$ | 4.0% |

After these flue gases are treated as mentioned previously in the description, there is obtained a clear solution containing about 30 wt % of HCl.

The flue gases discharged into the atmosphere contain no free chlorine.

Analyses performed on the flue gases show that the PCB content is below 0.5 $\mu g/Sm^3$; the content of polychorodibenzofuran and polychlorodibenzodioxin in the gases is 0.1 $ng/m^3$.

What is claimed is:

1. An injector (In) used to inject corrosive products or product mixtures, into a combustion chamber by bringing said products in a dispersed state into contact with an oxidizer at a temperature that allows said products to burn, wherein the injector comprises:

a straight cylinder wrapper tube (E), the wrapper tube (E) defining a space (ET) closed at one end by a wall (P), inside which wrapper tube (E) are juxtaposed at least two straight tubes (T) in the space ET, each straight tube (T) having an outside diameter with the straight tubes being spaced one from the other, at least two of the straight tubes (T) being of identical or different inside diameters, the straight tubes (T) individually passing at right angles through the end wall (P) closing the wrapper tube (E), at least one lateral nozzle (TL) through the wrapper tube (E) and situated near the wall (P) for conveying cooling air into the space (ET), and wherein at least one of the tubes (T) conveys corrosive products or product mixtures for burning in the combustion chamber and at least one of the tubes (T) conveys at least some of the oxidizer needed for combustion of said corrosive products.

2. The injector (In) as claimed in claim 1, wherein the injector comprises four tubes (T).

3. The injector (In) as claimed in claim 2, wherein the tubes (T) are arranged in a ring.

4. The injector (In) as claimed in claim 1, wherein the ratio of the outside diameter of a tube (T) to the inside diameter of the same tube (T) has a range of 1.2 to 1.6.

5. The injector (In) as claimed in claim 1, wherein the ratio of the total internal surface area of the tubes (T), $\Sigma S_T$, to the internal passage cross-sectional area of the wrapper tube (E), $S_{ET}$, containing n tubes (T) has a range of 1 to 1.50.

6. The injector (In) as claimed in claim 1, wherein the length of the wrapper tube (E) is 20 to 30 times the inside diameter of said wrapper tube (E).

7. The injector (In) as claimed in claim 1, wherein the outlet ends of the tubes (T) are in the same plane as the end of the wrapper tube (E).

8. The injector (In) as claimed claim 1, wherein the tubes are supplied upstream of the wall (P) by hoses fitted with "quick-fit" connectors.

9. The injector (In) as claimed in claim 1, wherein the corrosive products or product mixtures are chlorinated gaseous and/or liquid residues.

10. The injection as claimed in claim 1 wherein the ratio of the outside diameter of each tube (T) to the inside diameter of the same tube (T) has a range of 1.25 to 1.5.

11. The injector (In) as claimed in claim 1, wherein the ratio of the total internal surface area of the tubes (T), $\Sigma S_T$, to the internal passage cross-sectional area of the wrapper tube (E), $S_{ET}$, containing n tubes (T) has a range of 1.05 to 1.25.

12. The injector (In) as claimed in claim 1 wherein the straight tubes (T) are laterally spaced from the wrapper tube (E).

* * * * *